US010202784B2

(12) United States Patent
Parker et al.

(10) Patent No.: US 10,202,784 B2
(45) Date of Patent: Feb. 12, 2019

(54) CLUTCH AND HANDLE FOR LOCKABLE MECHANISM

(71) Applicant: SURELOCK McGILL LIMITED, Wokingham, Berkshire (GB)

(72) Inventors: Stuart Kenneth Parker, Portsmouth (GB); Glen Davies, Reading (GB)

(73) Assignee: SURELOCK MCGILL LIMITED, Wokingham (GB)

( * ) Notice: Subject to any disclaimer, the term of this patent is extended or adjusted under 35 U.S.C. 154(b) by 610 days.

(21) Appl. No.: 14/335,569

(22) Filed: Jul. 18, 2014

(65) Prior Publication Data

US 2016/0017634 A1 Jan. 21, 2016

(51) Int. Cl.
*E05B 17/00* (2006.01)
*E05B 1/00* (2006.01)
(Continued)

(52) U.S. Cl.
CPC ..... *E05B 17/0058* (2013.01); *E05B 1/003* (2013.01); *E05B 3/065* (2013.01); *E05B 13/002* (2013.01)

(58) Field of Classification Search
CPC ... Y10T 292/57; Y10T 292/59; Y10T 292/82; Y10T 292/85; Y10T 292/854; Y10T 292/865; Y10T 292/873; Y10T 292/876; Y10T 292/88; Y10T 70/5757; Y10T 70/5765; Y10T 70/5823; Y10T 70/5827; Y10T 70/5832; Y10T 70/5673; Y10T 70/5677; Y10T 70/542; Y10T 70/5819; Y10T 70/7712; Y10T 70/7723; Y10T 70/7949; Y10T 292/91; Y10T 292/93; Y10T 292/96; Y10T 292/14; E05B 17/0054; E05B 17/0058; E05B 13/00; E05B 13/002; E05B 13/004; E05B 13/101;
(Continued)

(56) References Cited

U.S. PATENT DOCUMENTS 1,516,152 A 4/1923 Dumont
2,058,930 A * 10/1936 Wichmann ..... E05B 3/08 292/336.5

(Continued)

FOREIGN PATENT DOCUMENTS

EP 0 341 656 A2 11/1989

OTHER PUBLICATIONS

Patents Act 1977: Search Report under Section 17(5) for corresponding United Kingdom Patent Application No. GB1412835.9, 4 pp., (Jan. 30, 2015).

*Primary Examiner* — Alyson M Merlino
(74) *Attorney, Agent, or Firm* — Womble Bond Dickinson (US) LLP

(57) ABSTRACT

A clutch and handle for applying rotation to a lockable mechanism is disclosed. In particular, the handle is adapted to prevent damage to the handle or a lockable mechanism when excess pressure or torque is applied to the handle. The torque limiting clutch mechanism limits the torque which can be applied by the handle such as to a lockable mechanism for securing a leaf within a frame. The torque limiting clutch mechanism comprises first and second rotors in confrontation to transmit rotational drive from the handle to the lockable mechanism. The first and second rotors are arranged to slip against each other beyond a maximum transferred torque.

24 Claims, 9 Drawing Sheets

(51) Int. Cl.
*E05B 3/06* (2006.01)
*E05B 13/00* (2006.01)

(58) Field of Classification Search
CPC ..... E05B 13/10; E05B 1/003; E05B 3/065; F16D 7/028
USPC ..... 464/41, 43
See application file for complete search history.

(56) References Cited

U.S. PATENT DOCUMENTS

| | | | | | |
|---|---|---|---|---|---|
| 2,293,085 | A * | 8/1942 | Steiber | F16D 1/09 | 464/38 |
| 2,770,115 | A * | 11/1956 | Ober | F16D 7/02 | 464/41 |
| 3,233,429 | A * | 2/1966 | Kohen | F16D 7/02 | 464/41 |
| 3,662,628 | A * | 5/1972 | Schnepel | B25B 23/141 | 464/36 |
| 4,773,240 | A | 9/1988 | Foshee | | |
| 5,265,924 | A * | 11/1993 | Kim | E05B 3/065 | 292/336.3 |
| 5,730,014 | A | 3/1998 | Berger et al. | | |
| 5,787,743 | A * | 8/1998 | Weigard | E05B 17/0058 | 292/336.3 |
| 6,439,078 | B1 * | 8/2002 | Schlude | B66D 1/58 | 254/352 |
| 6,527,314 | B2 | 3/2003 | Brown | | |
| 8,262,059 | B2 * | 9/2012 | Dolenti | F16D 7/044 | 251/77 |
| 8,720,960 | B2 * | 5/2014 | Nadgouda | E05B 13/005 | 292/252 |
| 2002/0113445 | A1 | 8/2002 | Brown | | |

* cited by examiner

CLUTCH AND HANDLE FOR LOCKABLE MECHANISM

TECHNICAL FIELD

The present invention relates to a clutch and handle for applying rotation to a lockable mechanism. In particular, the handle is adapted to prevent damage to the handle or lockable mechanism when excess pressure or torque is applied to the handle.

BACKGROUND

A conventional locking and bolting mechanism is shown in FIG. 1 and may comprise a bolt which is thrown by a handle to secure a door or leaf. The handle may be turned to retract the bolt and release the door or leaf. The handle may be locked by a key cylinder to prevent turning of the handle and thereby maintain the bolt in the thrown position securing the door.

Attacks on such bolting mechanisms may attempt to release the bolt by applying excess torque to the handle. The attacker hopes the excess torque will break the key cylinder and allow the handle to turn and retract the bolt. There are many techniques it is possible to employ to prevent the bolt being released in this way. However, the torque applied by the attacker may damage the handle or other parts of the bolting mechanism. If damaged it may be necessary to replace some or all of the bolting mechanism. To address this problem and prevent damage to the bolting mechanism a conventional solution is to include in the handle pre-weakened or frangible sections such that under excess torque the handle breaks along the pre-weakened sections. However, for the bolting mechanism to become operational again the handle must be replaced. This may take time and will incur costs. U.S. Pat. No. 6,527,314 describes a clutch handle apparatus for opening doors and the like, and includes a torque limiting clutch subassembly which selectively disengages a pin from a spindle to prevent damage. However, the clutch handle described therein is bulky and special techniques may be required to prevent damage to the pin.

SUMMARY OF THE INVENTION

The present invention provides a handle, such as a door handle, for applying rotation to a lockable mechanism for securing a leaf within a frame, the handle comprising a torque limiting clutch arranged to limit the torque which can be applied by the handle to the lockable mechanism. The limit to the torque prevents damage to the handle and/or lockable mechanism by excess applied torque. The lockable mechanism may be a lockable latch or bolt mechanism. Securing a door within a frame is performed, for example, by a bolt or latch, which secures the door in the closed position.

The torque limiting clutch may be arranged to provide slippage between rotation of the handle, or part thereof, and the lockable mechanism beyond a maximum transferred torque. The handle may comprise an actuator, such as a lever or turn knob and a housing for mounting to the leaf or door. Slippage may occur between input rotation to the actuator and output rotation drive to the lockable mechanism. The torque limiting clutch may be provided as part of a handle rose for fitting to a leaf or door, allowing later selection of handle.

The torque limiting clutch may comprise first and second rotors for engagement to transmit rotational drive from a handle to the lockable mechanism. The first and second rotors may be arranged to slip against each other when the maximum torque is reached.

The present invention provides a torque limiting clutch mechanism for a handle to limit the torque which can be applied by the handle, for example, to a lockable mechanism such as for securing a leaf within a frame, the torque limiting clutch mechanism comprises first and second rotors in opposition or confrontation to transmit rotational drive from the handle to the lockable mechanism, the first and second rotors arranged to slip against each other beyond a maximum transferred torque.

The first and second rotors in confrontation may engage to transmit the rotational drive.

The first and second rotors may each comprise a disc, plate or ring.

The first and second rotors may each surround a drive shaft. One of the first and second rotors may surround or encircle an input drive shaft and the other of the first and second rotors may surround or encircle an output drive shaft. The input drive shaft may be for receiving torque applied to the handle, and the output drive shaft may be for driving the lockable mechanism. The drive shafts may be aligned for coaxial driving.

The rotors may be coaxially opposing rotors, that is arranged for rotation about coaxially aligned axes and be in opposition, that is, facing each other.

The first and second rotors may be circumferential rotors. An external circumference of the first rotor may be arranged for engagement with an internal circumference of the second rotor. An external circumference or external circumferential surface may be an outer surface of a curved or circular form such as a ring or disc. An internal circumference or internal circumferential surface may be an inner surface which has a curved or circular form, such as the inner surface of an annulus of the surface or a circular hole or bore.

The external circumference of the first rotor may provide a conical surface to bear against the internal circumference of the second rotor. The conical surface may be at least part of a cone, such as a frusto-conical surface. The internal circumference of the second rotor may be tapered to receive the conical surface of the first rotor. The taper and/or conical surface may form an angle of at least 100° with the plane of rotation. The 100° angle may be formed in opposition directions for the conical surface and taper surface such that the 100° faces towards an input shaft for one of the surfaces and towards an output shaft for the other surface. The 100° angle may face towards the input for the first rotor and towards the output for the second rotor. The 100° angle of taper or conical surface corresponds to a 10° offset from normal to the plane of rotation. Other angles of taper may be used. Preferably, the angle of taper and conical surface is 105° (15° offset from normal to plane of rotation), but depending on the required torque limit this may be varied between 100° and 120° (10° and 30° offset from normal to the plane of rotation).

The first rotor may be arranged for engagement with the second rotor via bearings which may be held by the first rotor and second rotor. The bearing may also be considered as catches since they engage the two rotors together. The bearings may be held and retained in grooves in one of the rotors and may be held for release in grooves in the other of the rotors. Preferably, the bearings are held in grooves in the internal and external circumferences.

The bearings may be arranged to be released from grooves of the external surface when the torque limiting clutch mechanism is driven beyond the maximum transferred torque, to provide slippage between the rotors.

The bearings may be cylindrical rollers. Alternatively, the bearings may be ball-bearings.

The first rotor may be nested within the second rotor, that is, the first rotor fits inside the second rotor.

The second rotor may comprise an annular part forming the internal circumference, and a cap part for receiving a shaft. The cap part may be fixed to the annular part forming a recess in which the first rotor is enclosed.

The taper may be arranged such that the wider parts of the cone and taper are arranged towards the cap part.

The arrangement of a recess in the second rotor for nesting the first rotor may provide the clutch mechanism as self-contained capsule. A bias between the rotors may also be contained in the recess. An advantage of the self-contained nature of the clutch mechanism is that is can be easily incorporated in to locking and bolting devices as well as other devices.

The first rotor may be biased towards the second rotor. The bias may be provided by a Belleville washer, also known as a cupped spring washer. Such washers offer gradually increasing deflection against a flattening pressure, eventually becoming flat. The washer may be held in the recess between the first rotor and second rotor. The washer may urge the first rotor such that the conical surface is pushed towards the tapered surface.

The bias may be arranged for engagement of the first and second rotors for transmitting rotation from one rotor to the other.

The bias may be arranged such that when one of the rotors is driven beyond a maximum transferred torque, the first rotor disengages from the second rotor by the conical surface moving axially away from the tapered surface.

Preferably, the first rotor may be an input rotor for receiving applied torque from a handle and the second rotor may be an output rotor for transmitting rotational drive to the lockable mechanism. Alternatively the first and second rotors may be transposed such that the first rotor is the output rotor and the second rotor is an input rotor.

One of the rotors may be biased to return the rotor to a start position after driving.

The present invention provides a handle rose for mounting to a leaf for driving a lockable mechanism, comprising the torque limiting clutch mechanism set out above. By handle rose we mean a boss, often circular, for fitting a handle to a door or leaf. The handle rose may further comprise a housing, wherein the bias to return a rotor to the start position is provided by a torsion spring between the housing and a tang of the rotor.

The bias to return the rotor to the start position may preferably operate on the second rotor providing drive to the lockable mechanism. Alternatively, it may operate on the first rotor.

The bias may be arranged to operate in two directions to return the rotor to the start position when rotated in a clockwise or anti-clockwise direction.

One of the first and second rotors may comprise an axial aperture for receiving a shaft for receiving input rotation. The other of the first and second rotors may comprise an axial aperture for receiving a shaft for driving the lockable mechanism.

The present invention provides a handle for driving a lockable mechanism of a door or leaf, comprising the handle rose set out above and an actuator, such as a lever or turn-knob, for rotation by a user.

The present invention provides a door or leaf, comprising the handle set out above and a lockable mechanism for securing the door or leaf within a frame.

The present invention also provides an alternative arrangement of clutch. Again the first rotor is preferably an input rotor for receiving the applied torque and the second rotor is preferably an output rotor for transmitting rotational drive to the lockable mechanism. In this alternative arrangement the first and second rotors may engage in a similar manner to a dog clutch, but unlike a conventional dog clutch the rotors are also arranged to slip such that the rotors may be considered to provide a slipping dog clutch.

The rotors may be coaxially opposed discs.

One of the first and second rotors may be biased towards the other of the first and second rotors such that the rotors engage for transmitting rotation.

The rotors may be arranged such that beyond the maximum transferred torque, at least one of the rotors moves in an axial direction such that the rotors becomes spaced and out of engagement so as to provide slippage between them.

The bias urging one of the rotors towards the other rotor may be provided by a spring such as a conical compression spring. The bias may act on the input rotor to urge the input rotor towards the output rotor. The bias may instead, or in combination, act on the output rotor.

The first and second rotors preferably have drive axes which are coaxially aligned.

The bias urging one of the rotors towards the other rotor may be provided in the axial direction of the rotors. The bias may be arranged such that the axis passes through the centre of the bias or spring, for example, through the centre of the conical spring.

At least one of the first and second rotors may have one or more teeth for engagement with the other of the first and second rotors to transmit the rotation. The rotors may be arranged such that when the torque applied reaches the maximum transferred torque, the rotors move apart against the bias moving the teeth out of engagement to provide slippage between them.

The teeth may have a bevelled, chamfered or curved side or flank for slipping against the other rotor under over-torque drive. The bevel of the teeth may be at one or more sides or flanks of the teeth. If the bevel is provided at two sides or flanks of the teeth this permits slipping against over-torque drive in two directions. The bevel may form an angle of between 110 and 130°, or between 110 and 120°, with the plane of the rotor.

Each tooth may be received in a bevelled recess in the opposing rotor. The angle of bevels may be the same of each rotor. The recess may be bevelled at two sides.

One of the rotors may be biased to return the rotor to an undriven, normal or start position after driving. The start position may be considered to be the position of the handle without user torque applied. This position may be offset from an original position by slippage.

The handle may further comprise a housing, wherein the bias to return the rotor to the start position may be provided by a torsion spring between the housing and a tang of the rotor. The bias to return the rotor to the start position may operate on the output rotor. The bias may be arranged to operate in two directions to return the rotor to the start position when rotated in a clockwise or anti-clockwise direction.

The input rotor may comprise an axial aperture for receiving a shaft or spindle for receiving input rotation. The output rotor may comprise an axial aperture for receiving a shaft or spindle for driving the lockable mechanism.

The handle may comprise an actuator such as a lever or turn knob for rotation by a user. The actuator may operate on the first rotor.

The present invention also provides a door or leaf, comprising the handle set out above and a lockable mechanism for securing the door or leaf within a frame. The leaf may for example, be a window or other opening for which a lockable mechanism is provided.

The present invention also provides a torque-limiting clutch apparatus, such as for drive of a lock mechanism or lockable mechanism, the apparatus comprising: an input rotor for rotational driving by an actuator; an output rotor for rotational driving of, for example, a lock mechanism, wherein at least one of the rotors has teeth for engagement with the other rotor to transmit rotational drive from input rotor to output rotor, one of the input rotor and output rotor biased towards the other of the input rotor and output rotor, and wherein each tooth is bevelled, chamfered or curved for slipping against the other rotor under over-torque drive.

The torque-limiting clutches described above may be used with a handle for other door and lock based applications. For example, the torque-limiting clutch may be used as an anti-climbing device or as anti-barricade device. As an anti-climbing device the clutch would prevent a person from attempting to stand on the handle by the clutch slipping thereby turning of the handle. The slipping would also mean the torque as a result of standing on the handle would not be passed to the locking mechanism and would not permit a person to stand on the handle. As an anti-barricade device, a handle on one side of a door might be held in position by a user placing chairs or rods under the handle to maintain the lock or latch to secure the door, whereas a handle on the other side of the door could still be turned by a second user. This would be achieved by the clutch mechanism permitting slipping between driving of the handles on the two side of the door. This could be used a safety feature. The torque limit for these applications may differ to the standard lock-overdrive application.

BRIEF DESCRIPTION OF THE DRAWINGS

Embodiments of the present invention, and aspects of the prior art, will now be described with reference to the accompanying drawings, of which.

DETAILED DESCRIPTION

The present invention provides a handle for applying rotation to a lockable mechanism arranged to secure a leaf within a frame. The door handle comprises a torque limiting clutch arranged to limit the torque which can be applied by the handle to the lockable mechanism. The clutch may take the form of rotors such as toothed rotors, as in the first detailed embodiment described below. Other arrangements of torque limiting clutch are also considered, such as that of the second detailed embodiment described below. Other examples include a pair of concentric cylinders which might, for example, include teeth for engaging from the inner cylinder into the outer cylinder. Other features than teeth may be used but relative slipping between the clutch parts provide the torque-limiting function.

Figure 1:
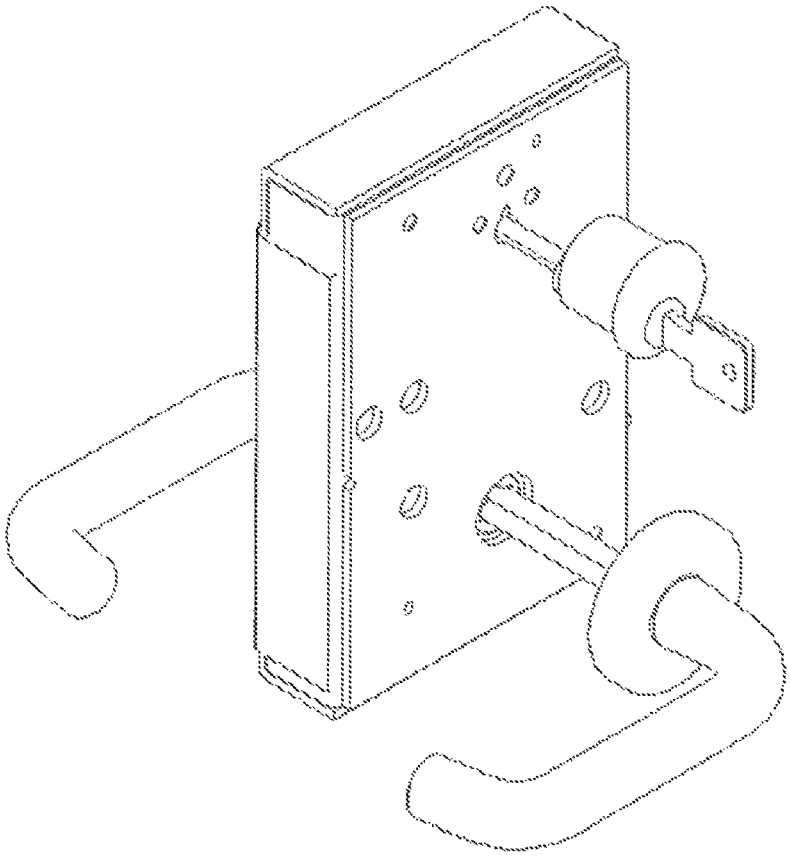
FIG. 1 is a perspective view of a prior art lock mechanism for fitting to a door or leaf.
Figure 2:
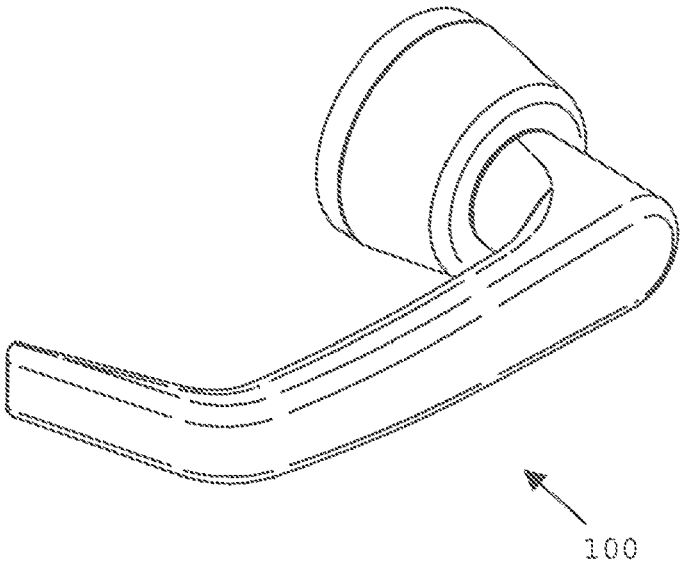
FIG. 2 is a perspective view of a handle assembly for driving a lock mechanism.
Figure 3:
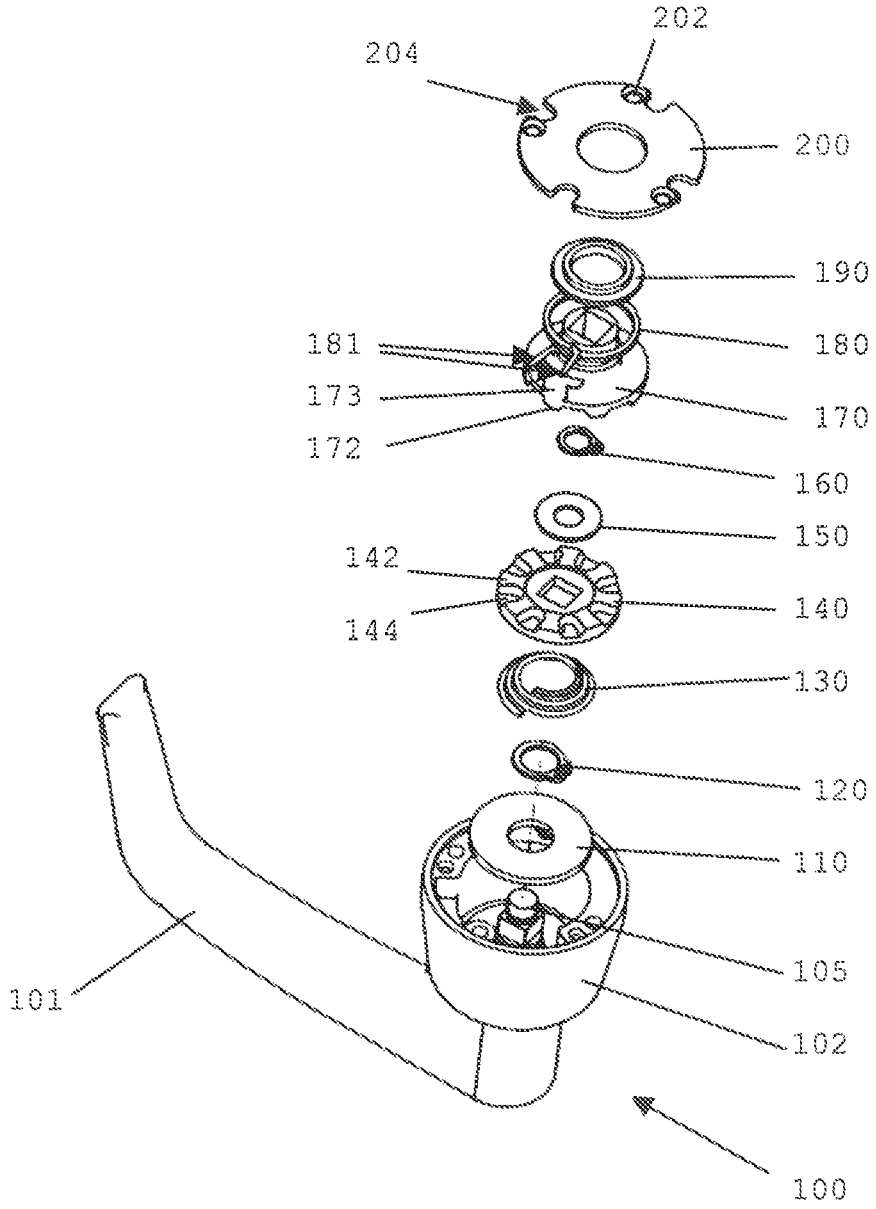
FIG. 3 is an exploded view of the handle assembly of FIG. 2.

FIG. 2 shows a handle 100 according to a first embodiment of the present invention. FIG. 3 is an exploded view of the handle assembly 100 of FIG. 2 showing the components of the handle. The handle assembly 100 comprises a clutch for limiting the torque transmitted from the handle 101 to a lock mechanism (not shown). The clutch comprises a pair of rotors. The first rotor or input rotor is driven by the handle. The second rotor or output rotor drives the lock mechanism. The input rotor transfers drive from the handle to the output rotor which drives the lock mechanism. The two rotors form a slipping dog clutch. Conventional dog clutches do not slip, but are designed to couple two rotating shafts by interference. The two parts of the conventional dog clutch are designed such that rotation of one pushes rotation of the other without slipping. Dog clutches allow drive to be engaged or disengaged between the two parts by moving the parts apart so that they no longer interfere. However, dog clutches do not permit continuous and gradual control of the amount of torque transferred. Conversely, a conventional friction clutch, such as used in automobiles and motor cars allows the amount of torque transmitted to be controlled by permitting the discs or rotors to slip against each other.

Figure 4A:
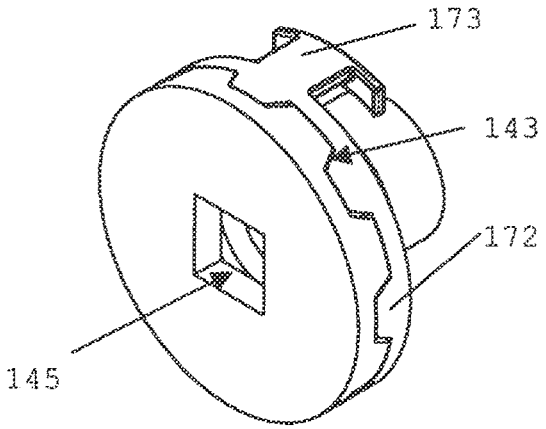
FIGS. 4A and 4C are perspective views of a rotor pair of the assembly of FIGS. 2 and 3.
Figure 4B:
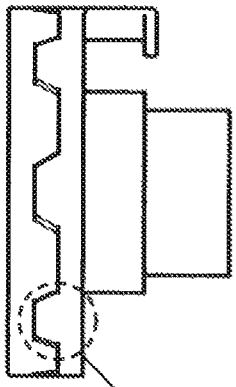
FIG. 4B is a side plan view of the same.
Figure 4C:
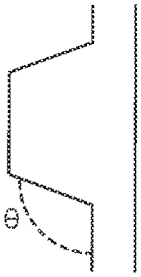
Figure 4C:
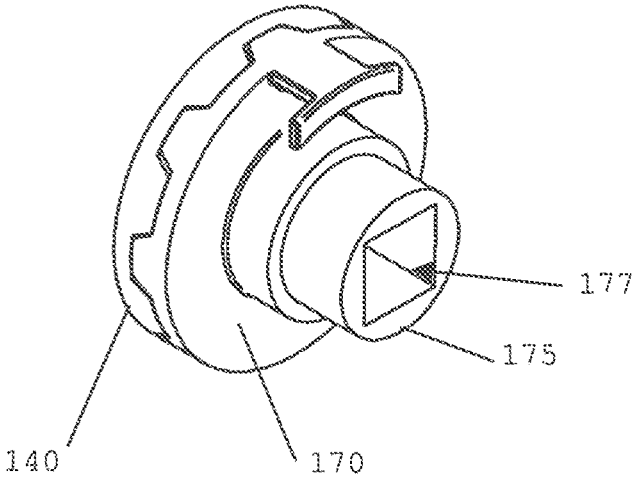

The rotors of the clutch are shown in FIG. 3 indicated by reference numbers 140 and 170 for input rotor and output rotor respectively. The input rotor 140 has a central aperture 145 for receiving and being driven by a spindle or shaft 105 of the handle. In FIG. 3, the spindle 105 of the handle appears to be connected to the handle, although it may be a separate part which engages with the handle. The rotors are discs or rings. The input rotor 140 has a series of teeth 142 which in FIG. 3 are shown located circumferentially. The teeth are separated by recesses 144. More detail of the input and output rotors in engagement is shown in FIGS. 4A-4C. The recesses in input rotor are each formed as a scalloped shape. The recesses have sloping or bevel sides 143. Output rotor 170 is similar to input rotor 140 having a central aperture 177 for receiving a driving spindle or shaft for driving the locking mechanism. The teeth 172 are provided as raised portions of the front face of the rotor. The teeth of output rotor also have sloping sides. The input rotor 140 and output rotor 170 may be considered as discs, one having teeth and the other having recesses. As shown in FIG. 4, output rotor has a collar 175 extending from the rear face of the rotor. The central aperture 177 for receiving spindle or shaft extends through the collar. The output rotor also includes a tang 173 which protrudes from the rear face of the rotor. The tang may be formed as a "T" shape extending away from the rear face and having short lateral projections, such as in line with the circumference of the rotor. FIG. 4*b* is a side view showing the teeth of the input and output rotors in engagement with each other. The sloping or bevelled sides can be seen. The slope results in the base of each tooth being wider than the top flat. The angle θ of slope is preferably between 110° and 120° but could be as great as 130°. The angle of the slope and the strength of the bias holding the rotors against each other determine the torque at which the rotors of the clutch begin to slip. The teeth may have other shapes than those shown in the figures, such as triangular shaped, or having curved bevelled sides. The figures show the rotors as having eight teeth but other numbers of teeth may be used.

Although we have described both rotors as having teeth, in an alternative arrangement only of the rotors has teeth and the other has recesses for receiving the teeth. In other arrangements features other than teeth may provide the engagement between the rotors, such as pins or fingers. In some embodiments it may be advantageous to have an intermediate rotor such that more than two rotors are provided, although for simplicity two rotors are preferred.

As shown in FIG. 3 a number of other components are included in the handle assembly 100. In between the rotors is spacer or washer 150. This is shown as an annulus but could be a disc. It locates in a recess between the rotors and at least partially blocks the central apertures 145, 177 of the two rotors. Since the rotors are arranged to operate on separate but coaxially aligned spindles or shafts, one for input and the other for output, the spacer 150 is required to prevent either of the shafts sliding into central apertures of both rotors. If this occurred the clutch would no longer function and input and output shafts would be locked together.

In the embodiment shown in FIG. 3, the rotor is held on to spindle by a fastener or clip 160 such as circlip or snap ring which is located in a groove at the end of the shaft or spindle 105 of the handle. The washer or spacer 150 performs an additional function of helping to secure the input rotor to spindle 105. Between the input rotor and handle a bias is provided to urge the input rotor towards the output rotor. In FIG. 3 the bias takes the form of a coiled conical spring 130 located axially on the shaft 105. Other forms of bias or spring may be used. At the one end, the spring pushes against the rear face of the input rotor 140. At the other end the spring pushes against a base such as a washer or ring 110. The base 110 is also held on shaft 105, and may be held in position by a fastener such as a circlip or snap ring. Other arrangements are possible in which the fixed base is integrally formed as part of the shaft. Alternatively the shaft may comprise a hole or recess in which part of the spring locates.

Figure 5A:
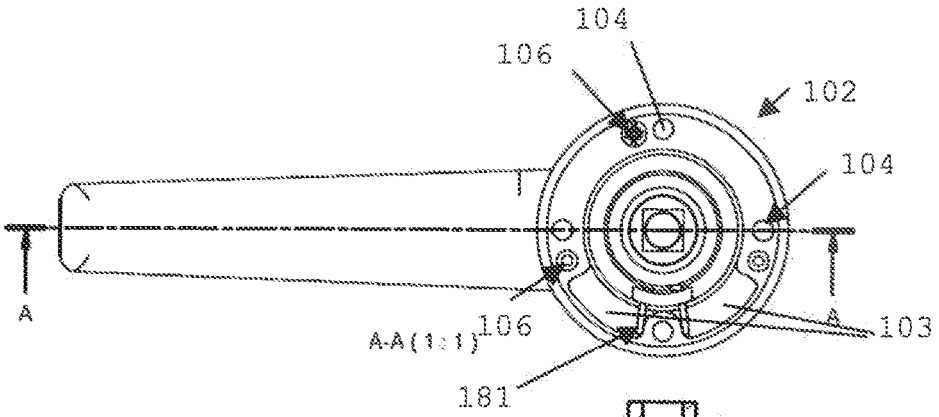
FIGS. 5A, 5B, and 5C are respectively a plan view of the rear (mounting side) of the handle assembly, a plan sectional view along the line A-A of FIG. SA, and a perspective sectional view along the line A-A of FIG. 5A.
Figure 5B:
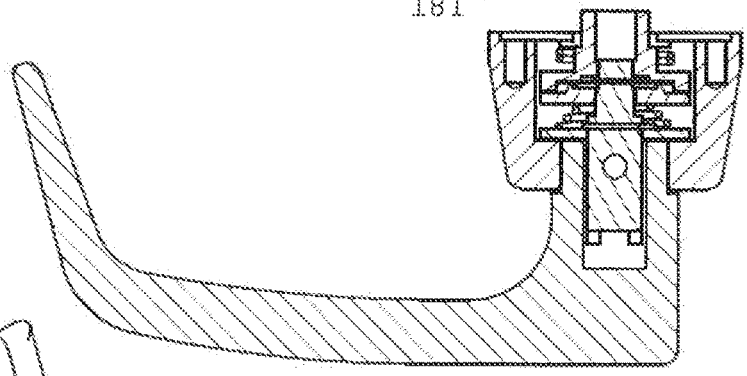
Figure 5C:
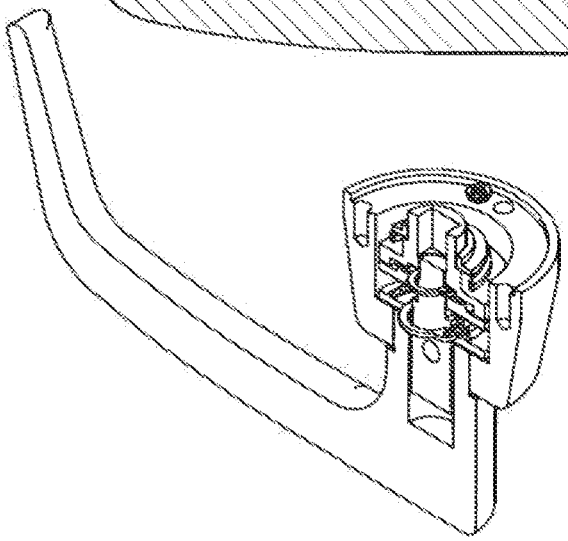

FIGS. 5A-5C show detailed views of the assembled handle. FIG. 5A shows the assembled handle from the rear, that is, from the mounting side. Features for mounting and biased return of the handle are shown. FIGS. 5B and 5C are sectional views along the centre of the handle assembly along line A-A of FIG. 5A. FIG. 58 is a plan sectional view, whereas FIG. 5C is a perspective sectional view.

The handle 101 is operated by rotational driving. The handle 101 is biased by the assembly to return the handle to its start or normal position. In the embodiments described this is achieved by output rotor 170 being biased to return to a start or normal undriven position. When the handle is driven or rotated for opening the door or leaf on which it is mounted, the handle is moved. Some locking mechanisms are themselves sprung to return the handle to a start position after driving. The arrangement shown in FIG. 3 includes bias to return the handle to its starting position whether the handle is used in right-handed or left-handed mode, such as on right or left hand opening doors. The bias is provided on output rotor by coiled torsion spring 180 which is located between mounting plate 200 and output rotor 170. The bias could alternatively be provided on input rotor. The torsion spring has actuating part which act against the moving parts to return the handle to the start position. The actuating parts may be end parts 181 of torsion spring which are bent radially to the spring such one end locates against tang 173 of outside rotor 170 and the other end locates in a recess 103 in a housing 102 of the handle. Details of the operation of torsion spring are provided below in relation to FIG. 7.

At least part of the housing, such as handle rose 102 is adapted for fixing to a door or leaf, for example, using mounting holes 104 such as for screw or bolts. Other fasteners to the door may instead be used. As shown in FIG. 5, the radially bent end parts 181 locate either side of tang 173 of output rotor and are held in place by projections of the tang. At the same time the radially bent end parts 181 locate in recesses 103 in housing. There are two recesses separated by a wall 103*a*. As shown in FIG. 5, each of the end parts 181 locates one side of the wall.

Output rotor 170 mounts to mounting plate 200 through support ring 190. Support ring 190 acts as a bearing collar to support the rotating output rotor 170. The mounting plate 200 has three holes 202 which are used for fastening the mounting plate to the housing 102 at corresponding holes 106. Threaded screws or bolts may be used as fastener. Mounting plate 200 also includes four notches 204 around its perimeter. The notches coincide with mounting holes 104 to allow a fastener to pass through for fixing the housing to a door or leaf.

Figure 6A:
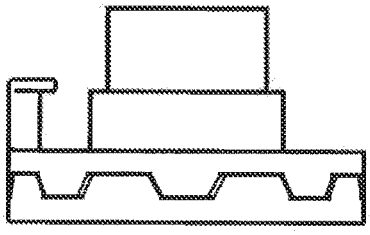
FIGS. 6A and 6B respectively are diagrams showing the rotors of the handle assembly in an engagement position and at the point of slipping.
Figure 6B:
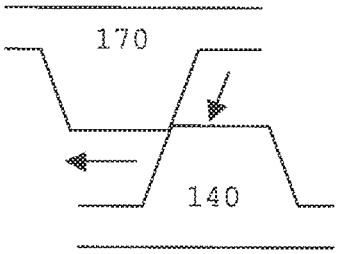

FIG. 6 shows operation of the input rotor and output rotors as the clutch. FIG. 6A shows the two rotors with the teeth of the input rotor in full engagement with the teeth of output rotor. In this position the conical spring or other bias pushes the two rotors together. Drive of the handle 101 drives rotation of shaft or spindle 105 which drives rotation of input rotor. The engagement of the teeth of the rotors causes drive to be transferred to output rotor to drive lock mechanism. FIG. 6B is a schematic view showing individual teeth of the two rotors at the point where slipping of the clutch is about to occur. In one arrangement the lock mechanism is locked such that rotational drive of output rotor is prevented. An operator may try to over-power the lock mechanism by applying excess force to the handle. For the handle assembly of the present invention turning of the handle will try to turn input rotor. Conical spring or other bias acts to try to keep the rotors pushed against each other with teeth in engagement. However, rotation cannot be transmitted to output rotor so the bevel or sloping edge of teeth of input rotor begin to slide against bevel or sloping edge of output rotor. This begins to push the rotors apart. If the torque applied to the handle is sufficient the bias urging the rotors together will begin to be overcome. At the position in FIG. 6B the teeth of the input rotor have slid up the slope of output rotor against the bias between them. Further torque applied to handle will causes the top of tooth of input rotor to ride over the crest of tooth of output rotor and the rotors will have slipped one tooth. The bias between the rotors will continue to try to push the rotors back together. The top of tooth of input rotor will slide down the bevel of the other side of the output rotor tooth. Continued over-torque on the handle will cause the rotors to slip by multiple teeth. However, no damage is done to the handle or lock mechanism. When lock mechanism is unlocked, driving of the handle will again drive the lock mechanism such as for release of a bolt. In some circumstances a user may try to over drive the handle even when the lock mechanism is unlocked. During normal usage rotation of the handle will be limited, for example, to rotation of around 45°. Continued torque after this will also cause the rotors to slip in the same manner as described above. Again, damage to handle or lock mechanism is prevented.

Figure 7A:
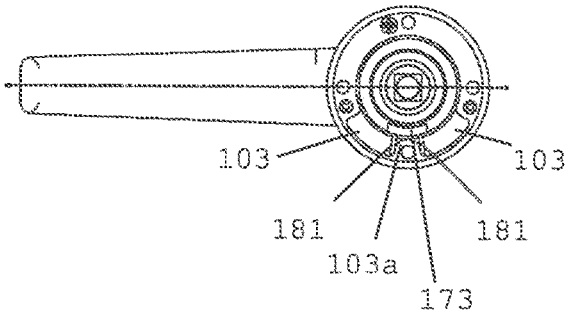
FIGS. 7A and 7B are diagrams showing the operation of the return bias on the output rotor.
Figure 7B:
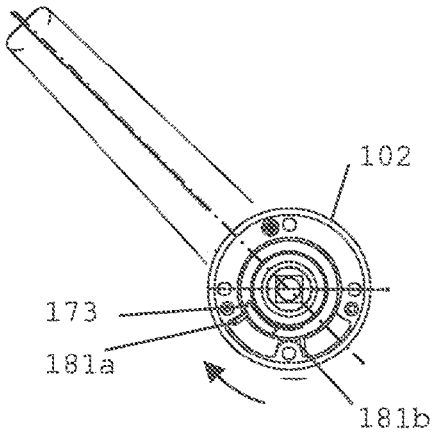

FIGS. 7A and 7B show operation of the bias to return handle to its undriven position after driving. In the embodiments described above, the bias is provided by a coiled torsion spring 180. This spring acts to return to its nominal shape and length when extended or compressed. The spring has actuating parts 181 which bear against other components of the handle assembly. In FIGS. 5 and 7 these are radially bent end parts of the spring. These bent end parts locate either side of tang 173 of output rotor and also locate in recesses of housing. At the undriven position the end parts 181 locate either side of wall 103*a* which separates the two recesses 103.

On driving the handle, input rotor is rotated. In FIG. 7B rotation is clockwise, but rotation anti-clockwise is analogous. In normal use the input rotor rotates rotor (unless locked). Tang 181 of output rotor is moved, for example as shown in FIG. 7B, by around 45° in recess 173. One end 181*a* of spring 180 is moved with tang. The other end 181*b* is held against wall 173. Hence, at rotation the spring 180 is extended. The spring acts to urge the tang and output rotor back to the start position. If operation is in the anti-clockwise direction the other end 181*b* of spring urges tang and output rotor back to start position.

In other embodiments the bias to return the rotors and handle to their start positions may act on the input rotor. Alternatively, no such return bias may be provided in the handle and movement to the start position may be derived from bias in the lock mechanism.

If the handle has been overdriven such that the rotors have slipped, for example, by one or more teeth, the return bias will operate to return the rotors to the slipped position, but not to the original position. For example, the handle may have been overdriven such that the rotors have slipped by one tooth. The start position of the handle is therefore offset from its original position by a small angle corresponding to the slippage. The handle is then rotated without over-torque drive to apply rotation to the lockable mechanism such as to release a latch or bolt. At the end of rotation the handle is released and the return bias returns the handle to its offset position. To return the handle further to its original position will require over-torque drive in the opposite direction to that producing the offset.

The person skilled in the art will readily appreciate that various modifications and alterations may be made to the above described embodiments without departing from the scope of the appended claims. For example, different springs or other types of bias may be used. Furthermore, the shape of the teeth of the rotors may also be different provided slipping is permitted. For example, instead of sloping or bevelled sides the sides may be curved. Different arrangements of tang may also be used. Furthermore, different shapes and sizes of parts may be provided.

Figure 8:
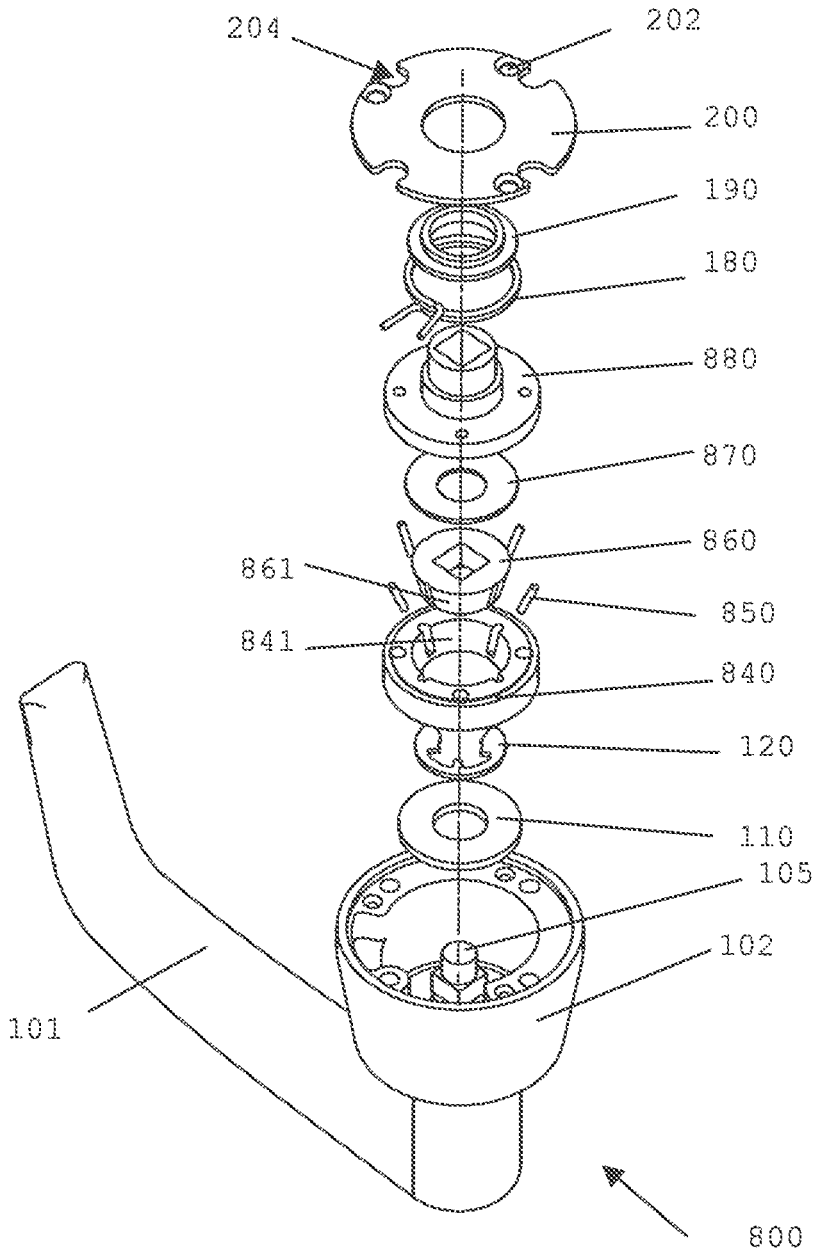
FIG. 8 is an exploded view of a handle assembly according to a second embodiment.

FIGS. 8 to 11C relate to a handle 800 and clutch according to a second embodiment of the present invention. Parts the same as those in FIG. 3 are indicated by like reference numbers. FIG. 8 is an exploded view of the handle and clutch of the second embodiment.

The torque limiting clutch within the handle of FIG. 8 has a different configuration compared to FIGS. 3 to 7. The clutch of FIG. 8 is based on the rotors of FIG. 3 but instead of having bevelled teeth for engagement and slippage of one rotor with the other, one rotor locates at least partly inside the other, with tapered edge surfaces facing each other. The teeth are replaced by rollers which act as catches and bearings. The rollers may be cylindrical rollers, balls, roller bearings or ball bearings in a bearing race.

In further detail, the handle assembly of FIG. 8 includes the handle or actuator 101, housing or handle rose 102, washer 110, circlip or snap-ring 120, coiled torsion spring 180, collar 190 and mounting plate 200 corresponding to those shown in FIG. 3. The clutch also comprises a first rotor 860 for receiving a drive from shaft or spindle of handle 105. The first rotor 860 has a central aperture for receiving the shaft or spindle 105. The curved outer surface or circumferential surface of first rotor comprises a tapered or conical surface 861 such as to form a truncated cone or frustum of a cone. The first rotor 860 might be considered to form a ring or annulus shape. The second rotor 840 also has a tapered circumferential surface 841 against which conical surface of first rotor faces against and is in close proximity to. The second rotor 840 may also be considered to form a ring or annulus. The first and second rotors again have axes of rotation which are coaxial. The first rotor 860 is arranged to at least partly fit inside the second rotor 840, that is, the second rotor has a central aperture larger than for fitting the spindle alone through. The central aperture of the second rotor is sized to receive the first rotor, but does not allow the first rotor to pass all of the way through it. The first rotor 860 may be considered to be nested within the second rotor 840. The tapered surface 841 of the second rotor is an internal surface which forms the surface of the central aperture, whereas the conical surface 861 of first rotor is an external surface.

Figure 9A:
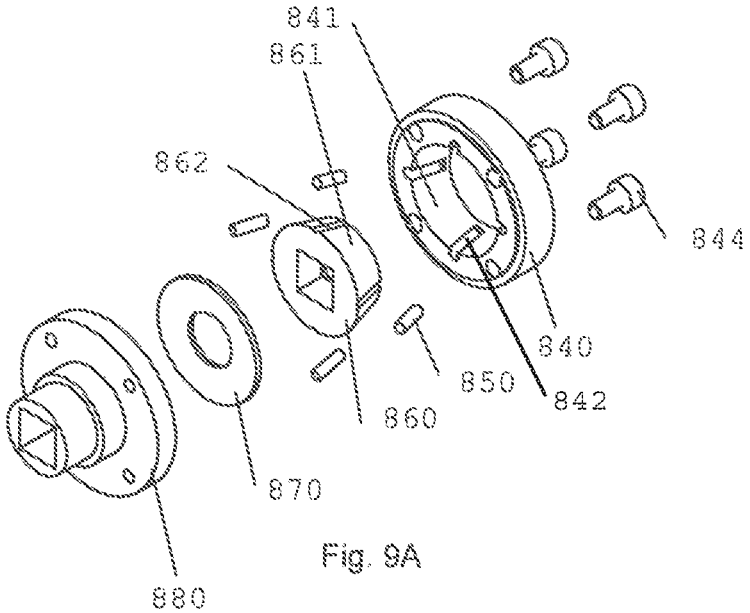
FIGS. 9A and 9B are exploded perspective views of the clutch of the handle of FIG. 8, from two viewpoints.
Figure 9B:
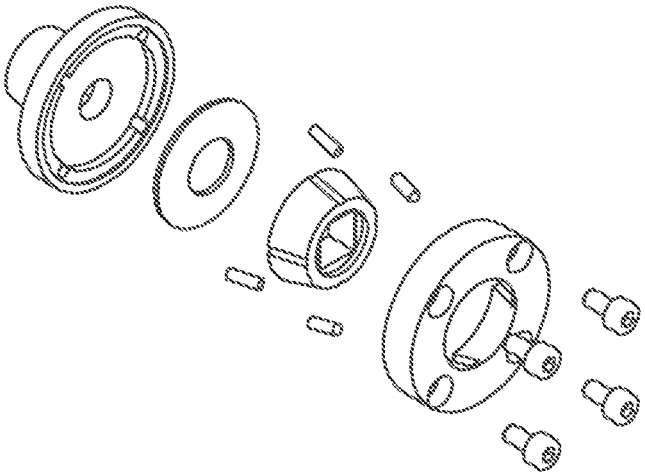

FIGS. 9A and 9B show the clutch in more detail. The first and second rotors have grooves 842, 862 cut into them into which are fitted bearings such as rollers 850. The grooves are cut into the tapered and conical surfaces such they are at an angle to the axis of rotation. Preferably the grooves are coplanar with the axis or rotation of the rotors. In FIG. 8 the rollers are shown as cylindrical bearings, but as mentioned above other components such as ball-bearings may be used. The grooves may be cut to different depths in the two rotors. For example, the grooves in one of the rotors may be deeper than those in the other rotor such that the rollers are retained in the grooves of the one rotor. If it is desired that they are retained in the grooves it is preferable if the grooves are deeper than half the height or diameters of the rollers. In the figures the grooves are cut deeper in the second rotor than in the first rotor such that the bearings or rollers are retained in the grooves of the second rotor, whereas the bearings can be released from the grooves in the first rotor. The figures show four rollers or bearings equally spaced around the rotors, but other numbers of rollers may be used.

Figure 10A:
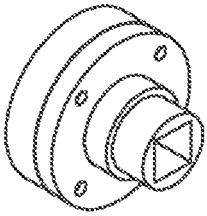
FIGS. 10A and 10B are respectively front and rear perspective views of the clutch.
Figure 10B:
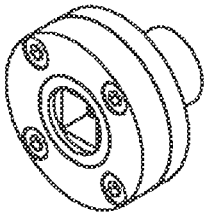
Figure 10C:
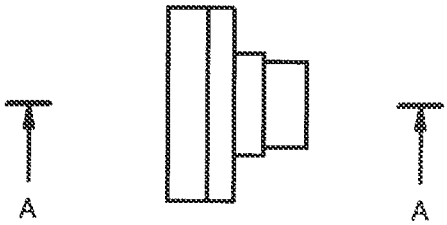
FIG. 10C is a plan side view.
Figure 10D:
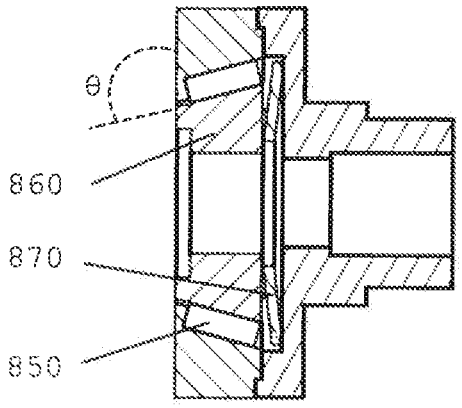
FIGS. 10D-10E are section views through the clutch taken along the line A-A of FIG. 4C with the rotors respectively engaged and disengaged.
Figure 10E:
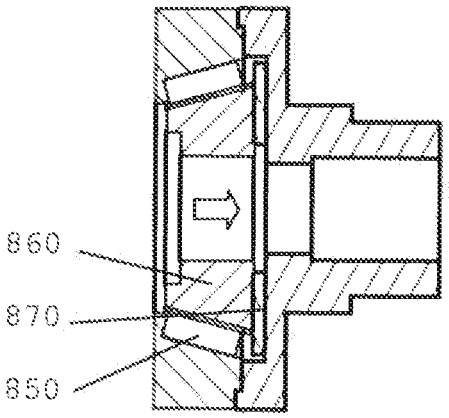
Figure 11A:
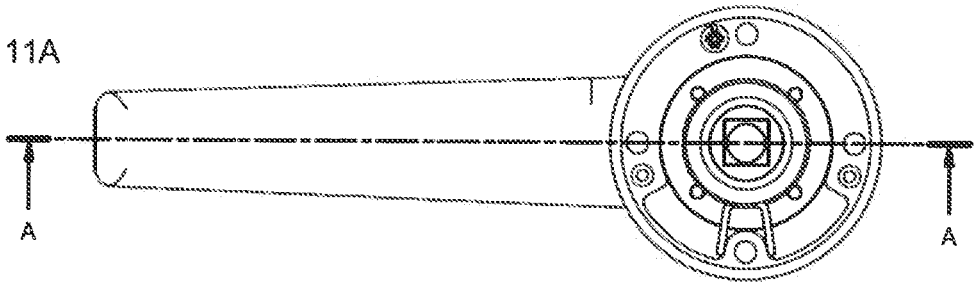
FIGS. 11A, 11B, and 11C are respectively a plan view of the rear (mounting side) of the handle assembly, a plan sectional view along the line A-A of FIG. 11A, and a perspective sectional view along the line A-A of FIG. 11A.
Figure 11B:
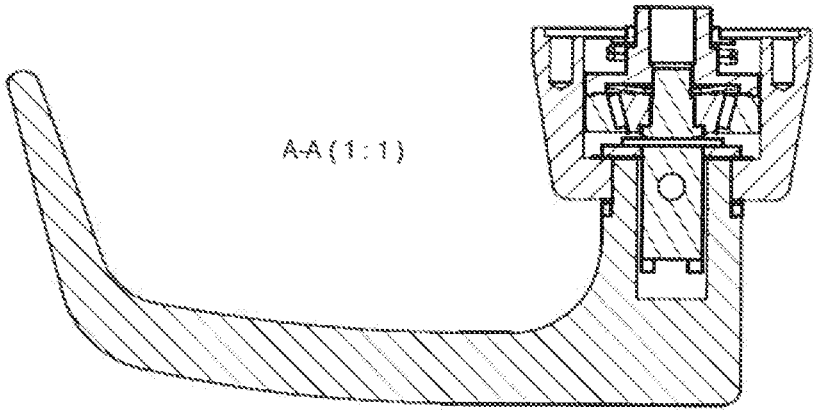
Figure 11C:
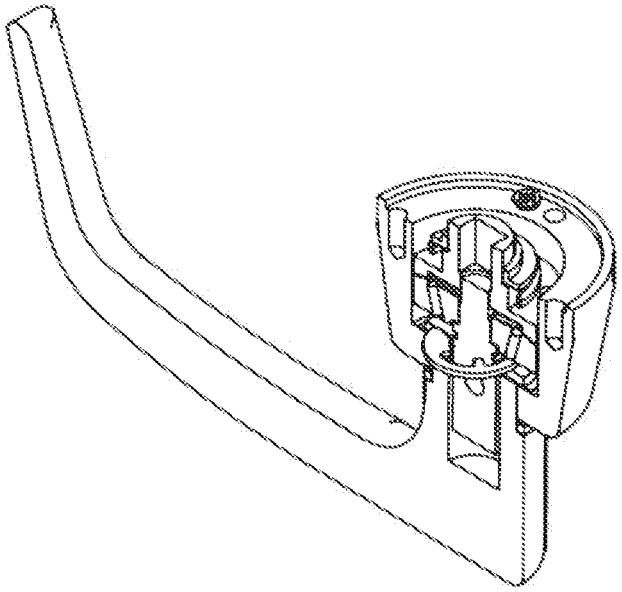

The first rotor 860 is driven by shaft or spindle 105 which fits and engages in central aperture of first rotor. Second rotor is coupled to cap or cap part 880 which includes a central aperture shaped to receive and drive spindle or shaft of lock mechanism. Second rotor includes a cap 880 which rotates with second rotor 840. Cap 880 is fixed to second rotor by fasteners such as screws or bolts 844, as shown in FIG. 9. Alternatively, cap 880 may be welded or fixed with adhesive to second rotor. Cap 880 and second rotor 840 together provide a cavity in which first rotor is enclosed. Between cap 880 and second rotor 840 is provided a bias to urge first rotor 860 towards second rotor 840. The bias is preferably a Belleville washer 870, also known as a cupped spring washer, but other types of spring may be used. Cupped spring washers are formed of a thin ring or annulus which has a slight conical shape. When sufficient pressure is applied to the washer it deforms to become flatter and eventually springs flat. The washer 870 urges the first rotor towards the second rotor. If the washer flattens or springs fully flat the first rotor moves away from the second rotor such that one can rotate freely of the other. FIGS. 10A-C shows views of the clutch. FIGS. 10D and 10E are cross-sections through the clutch respectively showing the rotors engaged and disengaged.

The second rotor 840 and cap 880 along with first rotor 860 and spring washer 870 form a self-contained clutch such as a capsule or may be considered to comprise a self-contained clutch hub unit. The self-contained clutch may be provided as part of handle assembly such as a door handle, or may be provided without the handle but as part of a handle rose into which a handle may be fitted. The compact arrangement of the clutch hub unit means that it can be included as part of handle rose for easy configuration with alternative handles or a user selectable handle. In further alternative arrangements the self-contained clutch may be included as part of a lock or lockable mechanism.

We now describe the operation of this second embodiment. The handle (when fitted) is provided with a shaft or spindle which locates in first rotor 860. The shaft or spindle may have a square cross-section such that rotation of the handle provides corresponding rotation to the first rotor. Under normal drive this rotation is transmitted to the second rotor by rollers which engage in the grooves of the two rotors. The rollers act like simple catches locking the rotation of the first rotor to the second rotor. Spring washer 870 pushes the first rotor toward the second rotor keeping the rollers in the grooves and pushing the rotors towards each other. The rotors may be in contact at their respective conical and tapered surfaces or, more preferably, they may be spaced apart a small amount. The space will be as a result of the total depth of the grooves in the first rotor and second rotor being slightly less than the diameter of the rollers or bearings 850. By having a small gap between the tapered and conical surfaces of the two rotors, friction between these surfaces does not need to be overcome for one rotor to move against the other.

If excess torque is applied to the handle the torque transmitted to the lockable mechanism is limited. In normal use the spring washer 870 urges the first rotor towards the second rotor and they are close enough that rollers are held in grooves in both rotors. If the torque is increased beyond a limit the grooves of the first rotor no longer engage the rollers and the angle of the taper causes the first rotor to move away from the second rotor against the bias of the spring washer. Hence, rotation of the first rotor will not be transmitted to the second rotor. In this condition the first rotor moves away from second rotor because of the angle of the tapered and conical facing surfaces and the rollers or bearings. Here the gap, if any, between the conical surface and tapered surface opens up such that the rollers or bearing now bear against the conical surface of the first rotor. Under high enough torque the pressure to move away from the second rotor overcomes the bias of the spring washer and the washer flattens partly or springs fully flat. The first rotor can now move away from the second rotor and the rollers are no longer in the grooves of the first rotor. The rollers remain in the grooves of the second rotor. The parts of the rollers sitting above the tapered surface of the second rotor provide a small surface area that the conical surface of the first rotor may contact and slide relatively easily. Thus the rotation of the first rotor under over-torque drive does not transmit the rotation to the second rotor. When the first rotor moves away from the second rotor to disengage from rollers, the first rotor moves or slides along the shaft or spindle which couples it to the handle.

The torque at which the first rotor slips against the roller and second rotor is predominantly determined by the angle of the tapered surface and conical surface at the circumference of the rotors. This angle is indicated by θ in FIG. 10D. The first and second rotors have substantially the same angles. The taper and cone surface are around 10° or more, such as 15° from the normal to the plane of rotation, such that the taper makes angles of 80° and 100° with the front and rear faces of the rotor. A steeper taper will cause the rotors to disengage at a greater torque, whereas a shallower taper will disengage at a lower torque. If no taper is present, such that the circumferential surfaces of the rotors are parallel to the axis of rotation, the rotors would not disengage.

The spring washer urges the first rotor to engage with the second rotor. The spring washer applies a constant force to the first rotor. The spring washer 870 under pressure will slowly flatten. When the spring washer 870 has flattened sufficiently the first rotor will be able to move away from the second rotor and disengage from the rollers. FIG. 10*e* shows the case where the spring washer is completely flattened. In this exemplary case, the first rotor is able to move around 1.5 mm towards the cap 880 which is enough for the first rotor disengage from the rollers. The angle of taper required for disengaging from the rollers can be calculated if the torque limit required in known. The torque limit is converted to a force or pressure on the spring washer to determine its deflection or flattening at that pressure. The taper is then set so that the first rotor will move sufficiently to disengage for the given amount of spring washer deflection. As mentioned above, FIG. 10E shows the spring washer fully flattened but the taper may also be designed for partial flattening, such as to a half collapsed state, or as required to obtain the required torque limit. Alternatively, different spring washers or other bias means may be used in order to achieve the desired torque limit.

After release of the handle the first and second rotors will be urged back towards each other by the spring washer but the rotational position of the first rotor may be such that the rollers do not engage in grooves of the first rotor. If this is the case, initial rotation of the first rotor will bring the first rotor around until the rollers re-engage with grooves of the first rotor. After this, further rotation will rotate the second rotor again, unless driven with excess torque.

Although we have described the above embodiment as having the first rotor driven by the handle and the second rotor driving the lockable mechanism, the rotors may instead be arranged in the reverse configuration with the second rotor driven by the handle and first driving the lockable mechanism.

As for the first embodiment, the second embodiment is provided with torsion spring 180 to return second rotor to its normal or start position. This can be seen in FIGS. 11B and 11C, which are cross-sections through the handle of FIG. 11A. The second rotor is provided with tang 173 against which torsion spring 180 bears. Tang 173 is not shown in FIGS. 8-11 to improve clarity. If first rotor is engaged with rollers in grooves, the return bias on second rotor will also return the first rotor and handle to its normal or start position.

The clutch arrangement of the second embodiment has advantages over that of the first embodiment in that it is more compact and self-contained. In the second embodiment the first rotor and spring washer are enclosed by the second rotor and cap. The clutch assembly of either embodiment may be housed in a rose for receiving a handle and mounting to the door. A standard rose may be chosen and used for different actuators or handles. The second embodiment is better adapted for supply as a handle rose because the first rotors is contained by the second rotor and cap whereas for the first embodiment they may require more support from the housing.

The person skilled in the art will readily appreciate that various modifications and alterations may be made to the above described embodiment without departing from the scope of the appended claims. For example, the rollers or bearings may be retained in the first rotor instead of the second rotor. Different numbers of rotors may be used and different angles of taper and cone may be used. Different springs or other types of bias may be used. Furthermore, different shapes and sizes of parts may be provided.

Although the clutch has been described herein by reference to a handle for driving a lock mechanism, the clutch may also find application elsewhere in locking mechanisms, bolting mechanisms and other securing means, as well as in other technical areas.

What is claimed is:

1. A handle rose for receiving a handle, the handle rose comprising a torque limiting clutch mechanism to limit a torque which can be applied by the handle to a lockable mechanism for securing a leaf within a frame, the torque limiting clutch mechanism comprising:

first and second rotors in confrontation to transmit a rotational drive from the handle to the lockable mechanism, the first and second rotors arranged to slip against each other beyond a maximum transferred torque, wherein the first rotor is for receiving the rotational drive from the handle and the first rotor comprises an aperture for receiving an input drive shaft for receiving the rotational drive from the handle, and the second rotor is for transmitting the rotational drive to the lockable mechanism and the second rotor comprises an aperture for receiving an output drive shaft for transmitting the rotational drive to the lockable mechanism, and wherein the second rotor comprises a recess in which the first rotor is nested, such that the torque limiting clutch mechanism is a self-contained capsule within the handle rose.

2. The handle rose of claim 1, wherein the first and second rotors, in confrontation, engage to transmit the rotational drive.

3. The handle rose of claim 1, wherein the first and second rotors each comprise a disc, plate, or ring.

4. The handle rose of claim 1, wherein the first and second rotors are coaxially opposing rotors.

5. The handle rose of claim 1, wherein the first and second rotors are circumferential rotors and an external circumference of the first rotor is arranged for engagement with an internal circumference of the second rotor.

6. The handle rose of claim 5, wherein the external circumference of the first rotor provides a frusto-conical surface to bear against the internal circumference of the second rotor.

7. The handle rose of claim 6, wherein the internal circumference of the second rotor is tapered to receive the frusto-conical surface of the first rotor.

8. The handle rose of claim 7, wherein the tapered internal circumference and/or frusto-conical surface extend(s) from an angle of at least 100° with a plane of rotation.

9. The handle rose of claim 6, wherein the second rotor comprises an annular part forming the internal circumference, and a cap part for receiving a shaft for transmitting the rotational drive to the lockable mechanism.

10. The handle rose of claim 9, wherein the cap part is fixed to the annular part forming the recess in which the first rotor is nested.

11. The handle rose of claim 1, wherein the first rotor is an input rotor for receiving the rotational drive from the handle and the second rotor is an output rotor for transmitting the rotational drive to the lockable mechanism.

12. The handle rose of claim 1, wherein one of the first and second rotors is biased to return the rotor to a start position when the rotational drive is removed.

13. The handle rose of claim 12, wherein the bias to return the one of the first and second rotors to the start position is provided by a torsion spring between the handle rose and a tang of the second rotors.

14. The handle rose of claim 13, wherein the second rotor is the rotor biased to the start position, and the bias applied to the second rotor is transferable to the first rotor.

15. The handle rose of claim 13, wherein the bias is arranged to operate in two directions to return the one of the first and second rotors to the start position when rotated in a clockwise or counter-clockwise direction.

16. A handle rose for receiving a handle, the handle rose comprising a torque limiting clutch mechanism to limit a torque which can be applied by the handle to a lockable mechanism for securing a leaf within a frame, the torque limiting clutch mechanism comprising:

first and second rotors in confrontation to transmit a rotational drive from the handle to the lockable mechanism, the first and second rotors arranged to slip against each other beyond a maximum transferred torque, wherein:

the first rotor is for receiving the rotational drive from the handle and the second rotor is for transmitting the rotational drive to the lockable mechanism, wherein the second rotor comprises a recess in which the first rotor is nested, such that the torque limiting clutch mechanism is a self-contained capsule within the handle rose, wherein the first and second rotors are circumferential rotors and an external circumference of the first rotor is arranged for engagement with an internal circumference of the second rotor, and wherein the first rotor is arranged for engagement with the second rotor via bearings held and retained by the second rotor and held for release by the first rotor.

17. The handle rose of claim 16, wherein the bearings are held and retained in grooves in the second rotors and held for release in grooves in the first rotors.

18. The handle rose of claim 17, wherein the grooves are in the internal and external circumferences of the second and first rotors, respectively.

19. The handle rose of claim 18, wherein the bearings are arranged to be released from the grooves of the external circumference of the first rotor when the torque limiting clutch mechanism is driven beyond the maximum transferred torque so as to provide slippage between the first and second rotors.

20. The handle rose of claim 16, wherein the bearings are cylindrical rollers.

21. A handle rose for receiving a handle, the handle rose comprising a torque limiting clutch mechanism to limit a torque which can be applied by the handle to a lockable mechanism for securing a leaf within a frame, the torque limiting clutch mechanism comprising:

first and second rotors in confrontation to transmit a rotational drive from the handle to the lockable mechanism, the first and second rotors arranged to slip against each other beyond a maximum transferred torque, wherein:

the first rotor is for receiving a rotational drive from the handle and the second rotor is for transmitting the rotational drive to the lockable mechanism, wherein the second rotor comprises a recess in which the first rotor is nested, such that the torque limiting clutch mechanism is a self-contained capsule within the handle rose, wherein the first and second rotors are circumferential rotors and an external circumference of the first rotor is arranged for engagement with an internal circumference of the second rotor, wherein the first rotor is biased towards the second rotor and the bias is provided by a Belleville washer or spring washer.

22. The handle rose of claim 21, wherein the Belleville washer or spring washer is held in a recess in the handle rose, in which the first rotor is enclosed, between the first rotor and the cap.

23. The handle rose of claim 21, wherein the bias is arranged for causing engagement between the first and second rotors for transmitting the rotational drive from the first rotor to the second rotor.

24. The handle rose of claim 23, wherein the external circumference of the first rotor provides a frusto-conical surface to bear against the internal circumference of the second rotor, and the internal circumference of the second rotor is tapered to receive the frusto-conical surface of the first rotor, and wherein the bias is arranged such that when the first rotor is driven beyond the maximum transferred torque, the first rotor disengages from the second rotor by the frusto-conical surface of the first rotor moving axially away from the tapered internal circumference of the second rotor.

* * * * *